US005655889A

United States Patent [19]

Gondek

[11] Patent Number: 5,655,889

[45] Date of Patent: Aug. 12, 1997

[54] COMBINED VARIABLE VOLUME AIR PUMP AND PERISTALIC PUMP

[76] Inventor: John T. Gondek, 1641 Innsbruck Cir. West, Columbia Heights, Minn. 55421

[21] Appl. No.: 490,091

[22] Filed: Jun. 13, 1995

[51] Int. Cl.[6] ..... F04B 23/10

[52] U.S. Cl. ..... 417/199.1

[58] Field of Search ..... 417/63, 415, 410.3, 417/470, 199.1, 477.1–477.9, 477.11, 477.12, 477.13, 477.14; 604/153; 222/135, 145.1, 145.5–147.8, 190

[56] References Cited

U.S. PATENT DOCUMENTS

| | | | |
|---|---|---|---|
| 2,029,941 | 2/1936 | Pokorney | 417/470 |
| 2,564,173 | 8/1951 | Rappi et al. | 417/470 |
| 3,163,355 | 12/1964 | Korte | 417/470 |
| 3,186,349 | 6/1965 | Compton et al. | 417/470 |
| 3,358,609 | 12/1967 | Worth et al. | 417/477.6 |
| 3,644,068 | 2/1972 | Lepak | 417/477 |
| 4,417,856 | 11/1983 | Minissian | 417/477 |

OTHER PUBLICATIONS

Stoelting model 219 Mix Pump Owner's Manual No. 1134067.Revised Jun. 1985 (31 pages).
Hajec handwritten memorandum dated Aug. 2, 1993.
Stoelting P.O. 16069–00 dated Aug. 4, 1993 to Vikeland ordering 10 ice cream mix and air pump per Jul. 8, 1993 B.GOCH requirement memo with 100" wall.
Falcon Electric Corp. Aug. 10, 1993 letter.
Falcon Electric Corp. Aug. 12, 1993 letter.
Vikeland (Kletch) Sep. 2, 1993 memorandum to Hajec (2 pages).
Stoelting Dec. 22, 1993 trip report (7 pages).
Stoelting PO81180–00 dated Mar. 7, 1994 for 50 U3 Ultima Pumps.
Stoelting May 5, 1994 letter to Chet Hajec (Vikeland).
Hajec May 16, 1994 letter to Stoelting.
Stoelting May 23, 1994 letter to Chet Hajec (Vikeland).
Stoeltng Oct. 4, 1994 letter to Chet Hajec (2 pages).
Stoelting Oct. 14, 1994 memorandum (4 pages).
Stoelting Nov. 30, 1994 letter to Chet Hajec.
Stoelting Jan. 5, 1995 memorandum (3 pages).
Stoelting PO 88009–00 dated Jan. 26, 1995.
Stoelting PO 88011–00 dated Jan. 26, 1995.
Stoelting Feb. 27, 1995 memorandum (2 pages).
Stoelting Mar. 16, 1995 memorandum (3 pages).
Stoelting Mar. 29, 1995 letter to Chet Hajec (2 pages).
Stoelting Apr. 4, 1995 letter to Falcon Electric.
Stoelting Apr. 17, 1995 letter to Falcon Electric.
Stoelting May 9, 1995 letter to Falcon Electric (5 pages).
Stoelting May 17, 1995 letter to Falcon Electric (2 pages).
Stoelting May 18, 1995 letter to B. Linnerooth (Falcon Electric) (3 pages).
Chester S. Hajec Declaration.

*Primary Examiner*—Timothy Thorpe
*Assistant Examiner*—Peter G. Korytnyk
*Attorney, Agent, or Firm*—Roger W. Jensen

[57] ABSTRACT

A combined constant-speed, variable-volume, piston-type air pump and peristalic pump. The air pump has a "minimum gap", i.e., has a piston head which is closely adjacent to the cylinder head at the completion of the compression stroke. The piston intake stroke is selectively adjustable between a maximum and a minimum position to thus vary the volume of air pumped. A motor means drives both pumps simultaneously. The peristalic pump comprises a pump housing mounted on a frame, having an inner circumferential track and a central opening. A rotor is positioned in said central opening, and has at least two rollers mounted thereon for rotation about axes parallel to said shaft axis. Flexible, compressible, hollow tube means is positioned between said rollers and said track.

16 Claims, 10 Drawing Sheets

COMBINED VARIABLE VOLUME AIR PUMP AND PERISTALIC PUMP

CROSS-REFERENCES TO RELATED APPLICATIONS

This application is related to two other applications filed by the Applicant concurrently with this application, i.e., Ser. No. 08/489,977 entitled *"Variable Volume Air Pump"* and Ser. No. 08/489,978 entitled *"Peristalic Pump"*, both now allowed.

BACKGROUND OF THE INVENTION

This invention has applicability to the general field of technology wherein it is desired to have, in a single apparatus, a variable volume air pump and a peristalic pump, both pumps being driven by the same prime mover such as an electric motor.

This invention, more specifically, is directed to the field of "soft" ice cream machines wherein air pumps are used to supply air which is combined with liquid ice cream mix to yield an air/liquid mixture. When a constant speed electric drive motor is energized, then the liquid ice cream mix is typically supplied at a constant rate by a suitable pump such as a peristalic pump. The air and liquid ice cream mix are combined in a mixer means such as a "T" connection and the resultant air/liquid mixture is pumped to a freezer-storage tank unit where the mixture is stored under pressure and the temperature of the mixture is reduced to a pre-selected point; the mixture then may be selectively dispensed into soft ice cream cones or other containers for customer consumption. It is very important to have accurate control of the ratio of air to liquid in the mixture for both the control of the quality, i.e., the "taste" of the soft ice cream and to provide a compressible air-liquid ice cream mixture so that the mixture can be stored under pressure in the freezer-storage tank unit. The prior variable volume air pumps used in soft ice cream machines have not been fully satisfactory. Additional information is helpful in understanding the shortcomings of the prior art pumps. It is important to have the air-liquid ice cream mixture under pressure in the freezer tank unit (as aforesaid) so that the pumps only be intermittently operated, i.e., continuous operation of the pumps is not desirable. A typical prior art system has a tank pressure sensor switching means which initiates pump action at 17 psi±3 psi (above atmospheric pressure) and which stops the pumping at 23 psi±3 psi. Also, at initial start up, the freezer tank is empty and at atmospheric pressure. For example, a prior art variable volume pump piston-type pump is characterized by having a significant variable clearance between the top of the piston head (when the piston head is at the maximum travel of the "up-stroke") and the cylinder head; thus there will be air remaining in the cylinder after the piston has completed its "up-stroke"; this creates a major problem because of the above described "system" characteristics. To explain, upon initial start-up of both the air pump and peristalic pump, since there is no tank "back pressure" for the pump to work against, the pump will deliver a very large volume of air greatly in excess of the desired amount for the desired ratio of air to liquid. Each successive compression stroke contributes (on a diminishing basis) to the incorrect ratio of air to liquid. For this type of air pump there is only one tank pressure at which the desired air/liquid mix ratio is achieved. Thus there is a problem upon initial start up and the problem continues after the tank is full as the system cycles between the low pressure start and high pressure stop as described above. Further, when the aforesaid prior art pump is subjected to a variation in atmospheric pressure, the air flow rate will vary because of the expansion or contraction of the air gap between the top of the piston and the cylinder head. For example, the pumps might be manufactured at a factory at an elevation 1,000 ft. above sea level, but the pumps might be used at a customer location at an elevation 5,000 ft. above sea level. Both of these problems are because of the air in the gap described above. Prior art air pumps with "zero gaps" are known; however, such pumps are not variable volume when driven at constant speed. The present invention provides, in part, a variable volume, "zero gap" air pump which is especially well suited for "soft" ice cream machine applications in combination with a peristalic pump.

SUMMARY OF THE INVENTION

The present invention is related to an apparatus comprising two pumps, i.e., an air pump and a peristalic pump both driven by the same prime mover such as an electric motor which typically would run at a constant speed when energized. More specifically, the present invention utilizes, for the air pump, a variable volume, "minimum gap" piston-type air pump which is described in detail in the above mentioned co-pending application of Applicant entitled *"Variable Volume Air Pump"*, the specific details as set forth in the specification, claims and drawings thereof are incorporated herein by reference.

Further, the present invention specifically includes a peristalic pump also driven by the aforesaid motor, which may be of the type shown in the above-mentioned co-pending application of Applicant entitled *"Peristalic Pump"*, the specific details of which as set forth in the specification, claims and drawings thereof are incorporated herein by reference.

Thus, the present invention may be summarized as a variable volume, "minimum gap" air pump and a peristalic pump, both driven simultaneously by the same prime mover, and wherein the air pump is further characterized by being of the piston-type, and wherein the piston, at the completion of the compression stroke, functions to push substantially all of the air out of the cylinder before the beginning of the piston intake stroke and where means are provided for adjusting the length of the intake stroke so as to selectively control the volume of air pumped by the pump for each cycle of the piston.

It is an object of this invention to provide an apparatus for use in "soft" ice cream machines comprising a unique combination of a variable volume air pump and peristalic pump, both operated simultaneously by the same prime mover means. Other objects and advantages of the invention will become apparent to those skilled in the art from the following description taken in connection with the accompanying drawings.

DESCRIPTION OF PREFERRED EMBODIMENT

Figure 1:
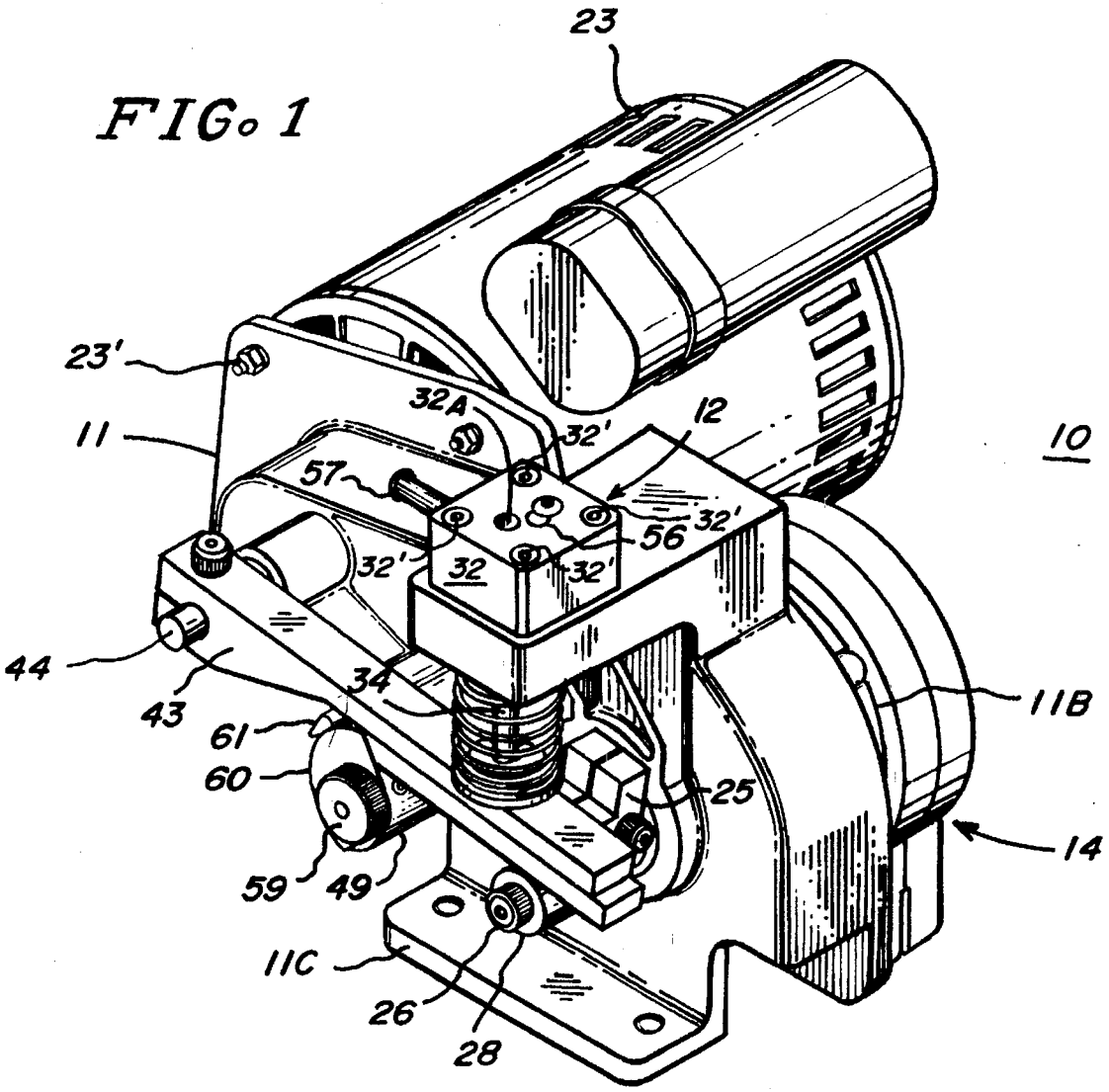
FIG. 1 is an isometric view of the unique apparatus.

Referring to FIG. 1, reference numeral 10 designates a combined air pump 12 and peristalic pump 14, both mounted on the same common frame 11. Air pump 12 is the subject matter of the above-mentioned patent application entitled *"Variable Volume Air Pump"* and the peristalic pump 14 is the subject matter of the above-mentioned patent application entitled *"Peristalic Pump"*; as indicated, both of the co-pending patent applications are incorporated herein by reference and may be referred to as appropriate in connection with an understanding of the present invention.

Figure 3:
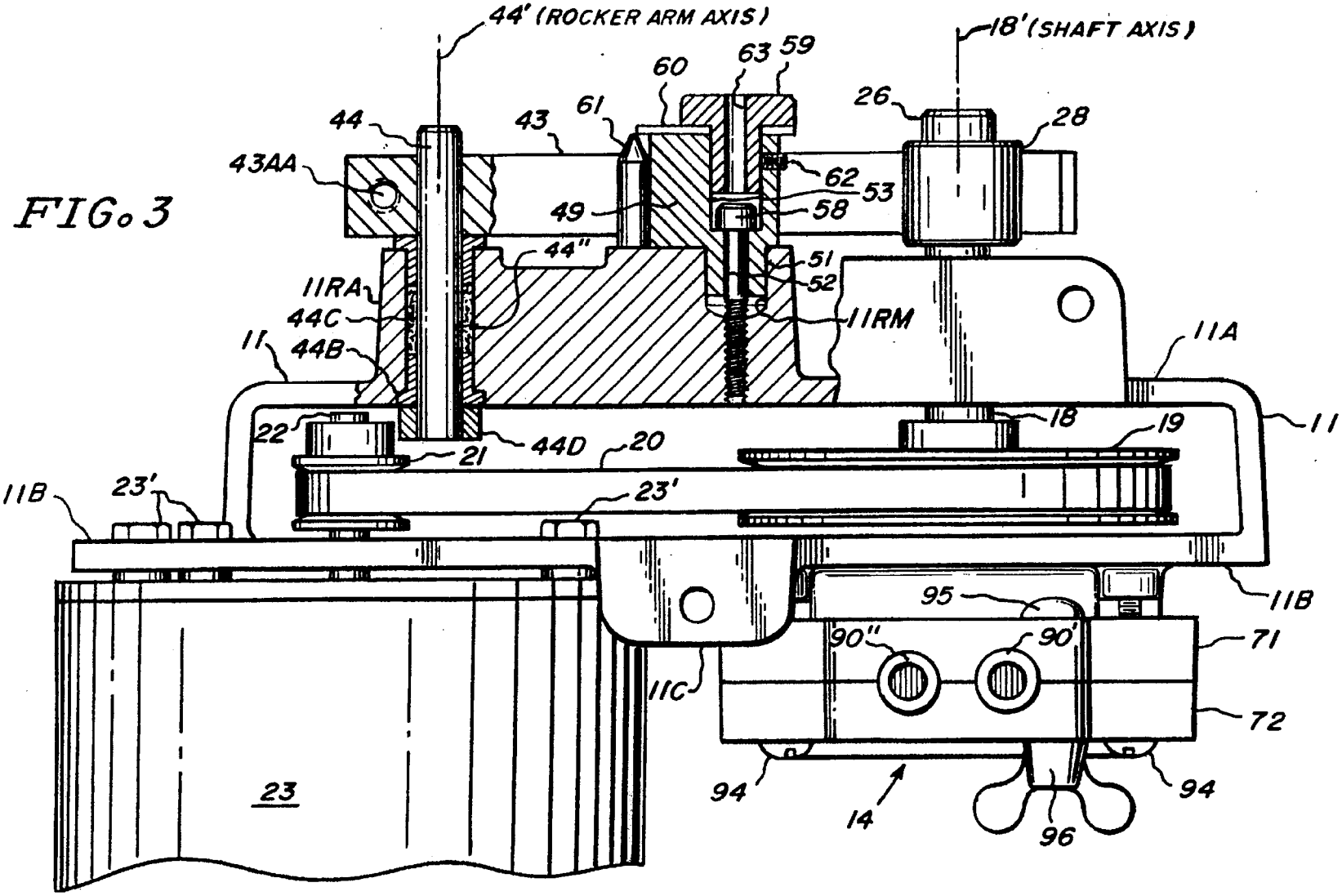
FIG. 3 is a bottom view, partly in section, of the apparatus.
Figure 4:
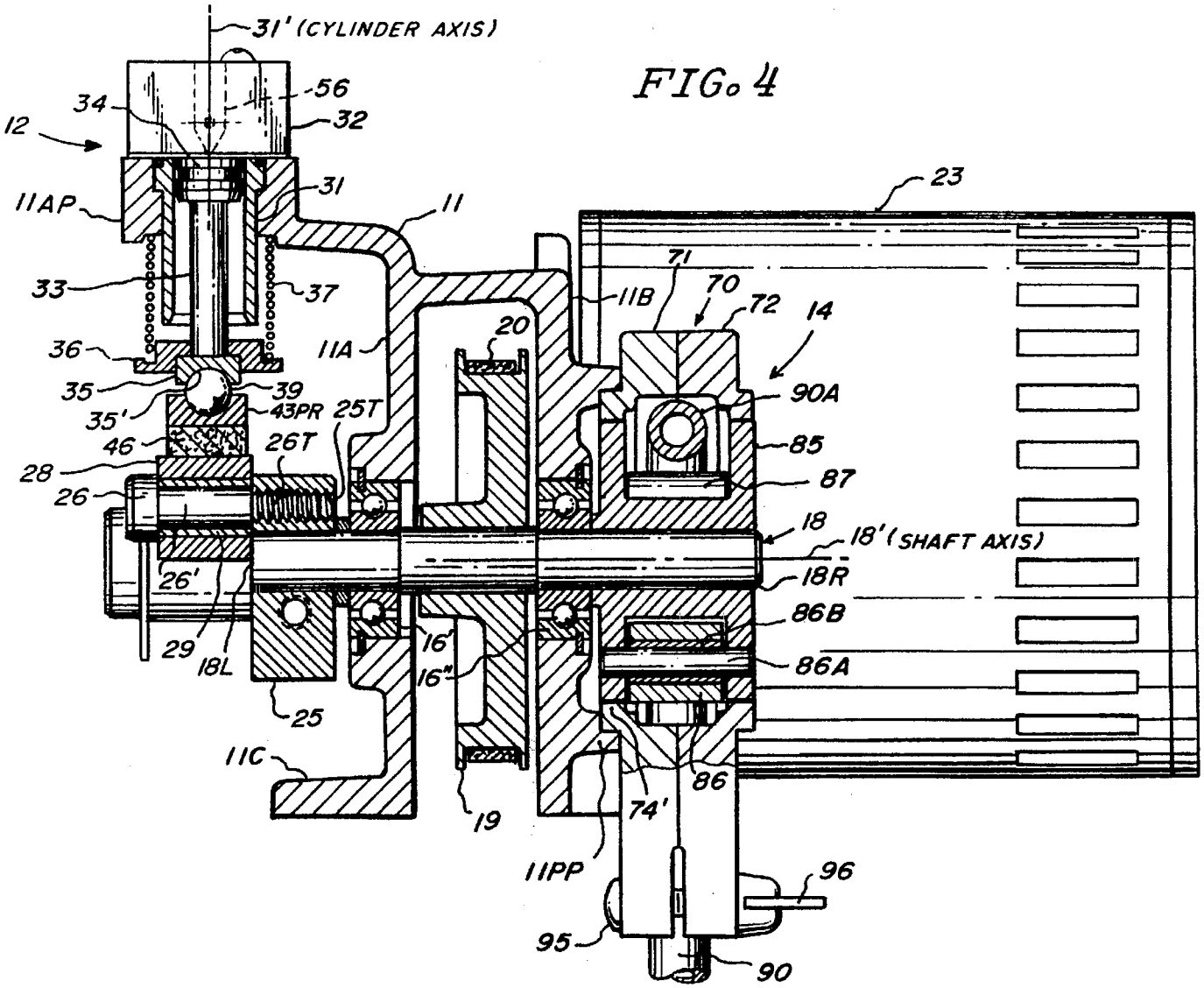
FIG. 4 is a vertical cross-section of both the air pump and the peristalic pump as viewed along section lines 4AA—4AA of FIG. 5.

The frame 11, a portion of which is shown in cross-section in FIG. 4 comprises a pair of spaced-apart parallel wall portions 11A,11B. A first pedestal or mounting foot 11C is provided at the bottom of wall portion 11A as depicted in FIG. 4. Centrally positioned in portions 11A and 11B are a pair of ball bearings 16' and 16" respectively which support a shaft 18 for rotation about a shaft axis 18'. Means for rotating the shaft 18 include a large pulley 19 fixed to shaft 18 and positioned between portions 11A and 11B of the frame. A pulley belt 20 engages the operative driving surface of pulley 19 and extends to engage with a smaller pulley 21 shown in FIG. 3 and fixed to a motor shaft 22 of a motor 23 which in turn is attached to frame wall portion 11B by suitable fastening means 23'. In the preferred embodiment, motor means 23 is a single phase, AC electric motor which, when energized, will drive shaft 22 at a constant angular velocity and thus, through the pulley 21, belt 20 and pulley 19 drive the shaft 18 at a slower but constant angular velocity. A second pedestal or mounting foot 11C' is integral with frame wall portion 11B (see FIG. 3).

Variable Volume Air Pump

Referring to FIG. 4, the left end of shaft 18 is identified by reference 18L and has attached thereto a crank arm 25 which rotates unitarily with shaft 18 and supports a crank comprising a shoulder screw 26 having a threaded portion 26T screwed into a threaded aperture 25T in the crank arm 25. A smooth shank portion 26' of shoulder screw 26 supports for rotation therewith a roller 28, a bearing means 29 interposed between shank portion 26' and roller 28 facilitating the free rotation of roller 28 about the axis defined by the shoulder screw 26. Thus rotation of shaft 18 rotates crank arm 25 and roller 28 attached thereto, as aforesaid.

A portion 11AP of frame 11 shown in the upper left hand portion of FIG. 4 supports a pump cylinder 31. A cylinder head 32 is aligned with cylinder 31 and is attached to the frame portion by suitable means such as machine screws 32' shown in FIG. 1. The pump cylinder is depicted as being a hollow cylindrical tubular member held in a bore to the frame portion 11AP and depending therefrom along a longitudinal cylinder axis 31' perpendicular to the shaft axis 18'.

Figure 6:
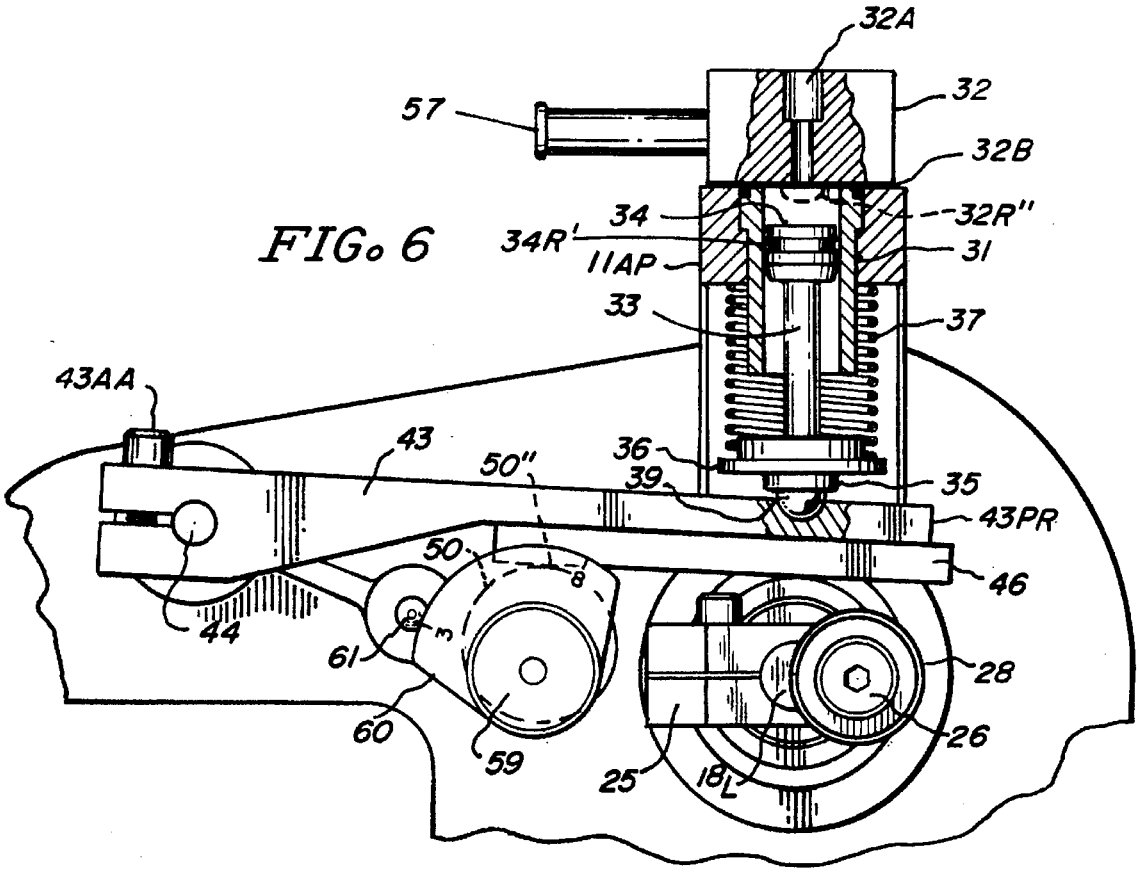
FIG. 6 is a partial left side view showing the rocker arm being held in position by the eccentric means rotated to a position different from that shown in FIG. 2.

An elongated piston rod 33 having a piston head 34 (with piston "O" ring 34R and GLYD ring 34R', see FIG. 7) at one end thereof is positioned within cylinder 31 for relative reciprocation along the cylinder axis 31'. In FIG. 4 piston head 34 is shown immediately adjacent to cylinder head 32, this is the position of the piston head when the piston rod is moved to the completion of the compression stroke. In FIG. 6, the piston head is shown displaced downwardly or away from the cylinder head, i.e., at the completion of the intake stroke. The other end 35 of the piston rod 33 has two functions. The first function is to support a spring seat 36 which in turns co-acts with a coil spring 37 which is positioned between the spring seat 36 and the frame portion 11AP and functions to bias the spring seat and the end 35 of the piston rod so that the piston head 34 is biased away from the cylinder head 32.

The second function of end 35 of the piston rod is to provide a means for receiving force tending to move the piston head toward the cylinder head. More specifically, end 35 has a curved recess 35' (see FIG. 4) for receiving a portion of the spherical periphery of a ball bearing 39.

The invention further includes a piston rod engagement means shown, in the preferred embodiment, as a rocker arm 43 connected and locked by screw means 43AA to a shaft 44 for limited rotation about a shaft axis 44' (see FIG. 3), the shaft 44 being rotatably supported by a pair of bushings 44A and 44B positioned at opposite ends of a bore 44" in portion 11RA of the frame 11. A lubricant impregnated felt 44C is placed between bushings 44A and 44B for lubrication thereof. A collar 44D attached by a press fit to shaft 44 adjacent to bushing 44B as shown in FIG. 3 holds the assembled shaft 44 and rocker arm 43 in the position shown in FIG. 3. As shown in FIG. 3, the rocker arm axis 44' is parallel to abut spaced from the shaft axis 18'.

The rocker arm 43 has a significant longitudinal length which permits the rocker arm to be positioned to engage the other end 35 of the piston rod. See, for example, FIG. 2. The end of the rocker arm which engages the end 35 of the piston rod is designated in FIGS. 2 and 4 by reference numeral 43PR and more specifically a suitable spherical, cup-like recess 40 is provided in end 43PR for co-acting with the ball 39.

Thus the rocker arm 43 is pivotally mounted on the frame. Further, the rocker arm is positioned to engage the other end of the piston rod whereby the rocker arm is biased by the force of the spring bias means 37 to move away from the cylinder head 32. Further, the rocker arm is positioned so as to be periodically contacted by the roller 28 carried by the crank arm 25. The rocker arm 43 is made from any suitable rigid material such as aluminum and the roller 28 also would be made out of a suitable material such as aluminum. To provide a shock absorption means to reduce shock and noise upon impact of the roller 28 with the bottom surface of the rocker arm 43, a shock pad 46 or an appropriate resilient material is bonded to the underside of the rocker arm 43. Thus the roller 28 periodically contacts the shock pad 46.

The invention further includes an adjusting means for selectively varying the extent of movement of the piston rod engagement means away from the cylinder head to thereby vary the length of the intake stroke travel of the piston rod. More specifically, the adjusting means in the preferred embodiment is shown as an eccentric means 49 shown in detail in FIGS. 2, 3 and 6 to include a circular surface or periphery 50 and a stepped bore 52,53 (see FIG. 3) defining an axis which is eccentric to the surface 50. The lowest and highest points of the surface 50 from the axis are identified by reference numerals 50' and 50", and shown, respectively, in FIGS. 2 and 6. The eccentric 49 further includes a hub portion 51 concentric with the axis. Referring to FIG. 3, a bore 11RM is provided in frame 11 and is adapted to receive the hub 51 of the eccentric 49. The fit of the hub 51 in recess 11RM is intended to be snug and yet permit relative rotation of the eccentric means within the bore 11RM. Separate means are provided for locking the eccentric means about its rotational axis. As depicted, the locking means comprises a socket head screw 58 adapted to be inserted through bore 52 with the screw head contained within bore 53 and a threaded end portion of the screw adapted to engage a threaded recess in frame 11 as is clearly shown in FIG. 3. The adjustment means further includes a knob 59 having a smooth shank adapted to be positioned within bore 53 and to be held in position therewith by a setscrew 62. The knob 59 has a bore 63 therethrough to permit the insertion of a torque producing means such as a hex wrench to engage the head of screw 58. Also an index 60 (see FIGS. 2, 3 and 6) is positioned between knob 59 and is bonded to the eccentric 49 to rotate unitarily with the eccentric 49 about its axis, the index 60 co-acting with a pointer 61 attached to the frame 11 to provide a visual indication of the position of the eccentric 49.

Figure 2:
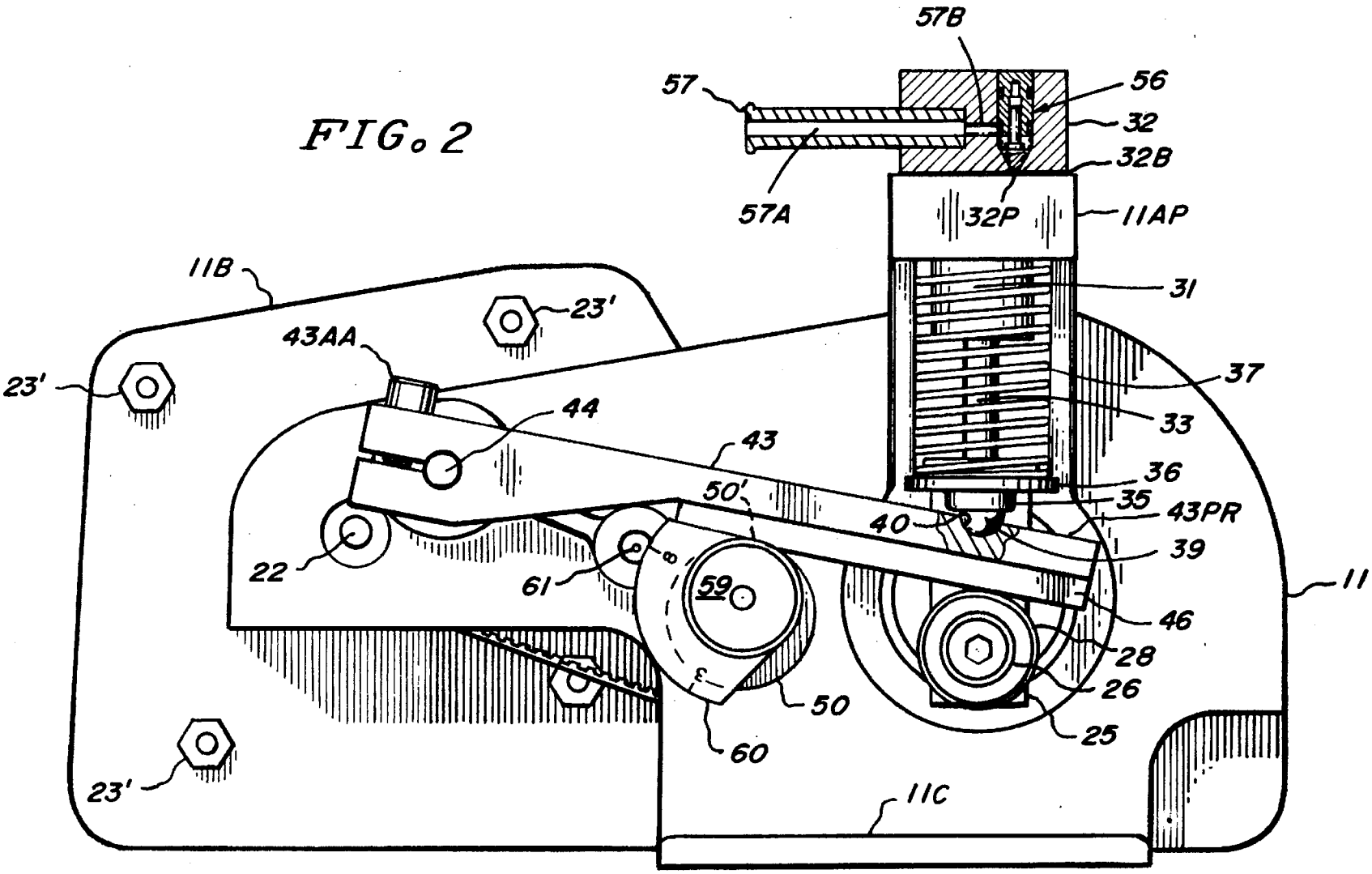
FIG. 2 is a left side view, partly in section, of the apparatus.

The adjusting means as shown in FIG. 2 has the eccentric means 49 rotated about its axis so that the "lowest" point 50' of surface 50 is engaging the underside of shock pad 46 so as to permit the maximum travel of rocker arm 43 away from the cylinder 31. In this configuration the piston has a maximum of intake travel. FIG. 6 shows the eccentric 49 rotated so that the "highest" point 50" of cam surface 50 is engaging the underside of shock pad 46 so that the rocker arm 43 is positioned substantially closer to the cylinder head 32 as compared to the position shown in FIG. 2. Thus, in the FIG. 6 configuration, the piston rod would have a minimum amount of intake travel. It will be understood that the eccentric 49 may be designed to yield the desired pre-selected maximum and minimum down-stroke positions of the piston rod 33.

Figure 9:
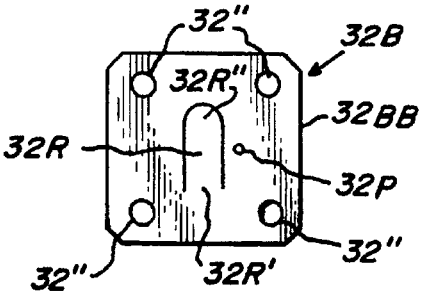
FIGS. 9 AND 10 show top and side views of the pump inlet check valve.

The pump further includes "outside" air inlet means in the form of (i) a stepped bore or port 32A in cylinder head 32 and (ii) a reed-type intake check valve 32B adapted to admit air into the pump cylinder during the intake stroke and to prevent airflow during the compression stroke. The reed-type intake check valve 32B is shown in FIGS. 2 and 6 and in greater detail in FIGS. 9 and 10 and comprises a generally flat, thin plate 32BB made from a suitable material such as a hard tempered 301 stainless steel strip 0.003 inches thick. Valve plate 32BB (see FIG. 9) has a generally square plan view shape with screw holes 32" in the four corners through which pass the screws 32' which hold the cylinder head 32 to frame portion 11AP, as aforesaid.

Figure 10:
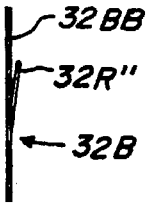

Valve plate 32BB further includes a centrally positioned reed 32R having a tongue 32R" shown in FIGS. 6 and 10 in its displaced position, i.e., when air is admitted during the intake stroke. As soon as the air stops flowing through the opening in 32B caused by the deflection of tongue 32R", the reed 32R will spring back to its "at rest" position against the cylinder head 32 (FIG. 6).

A small diameter port or bore 32P (see FIG. 9) through the plate 32BB co-acts with and is part of an outlet or discharge means described below.

Figure 2A:
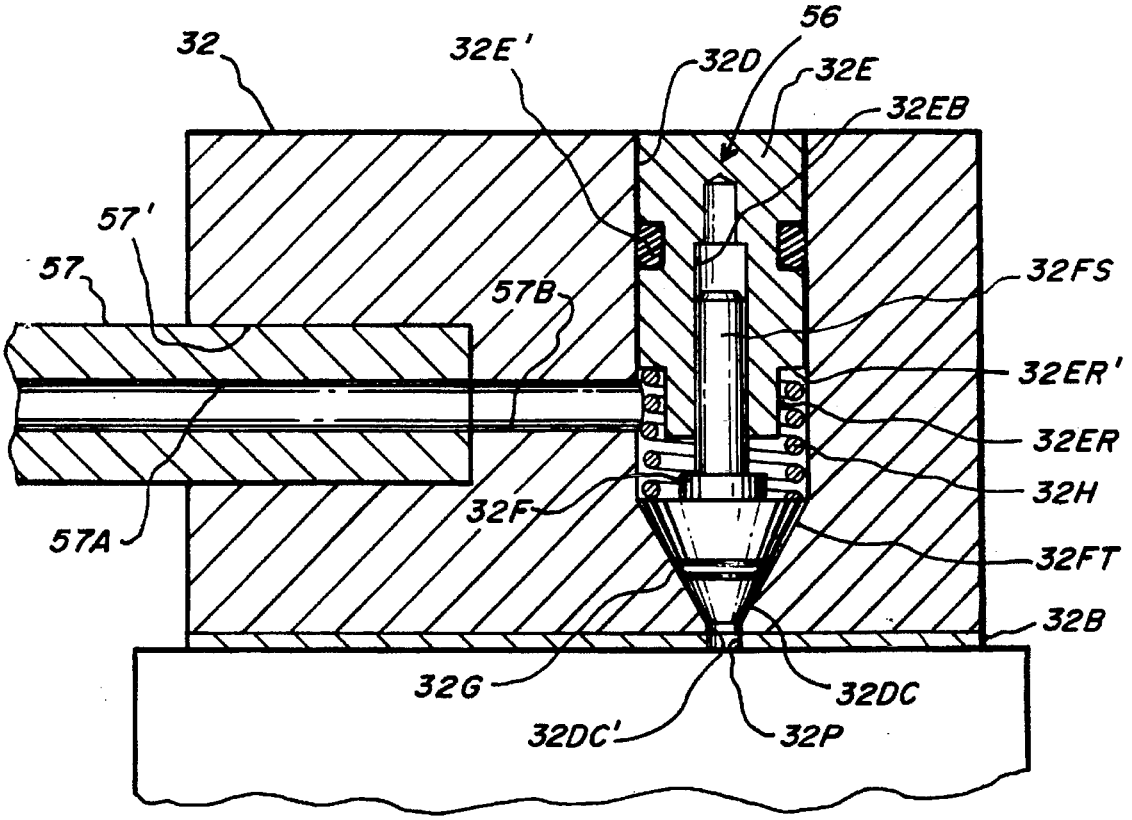
FIG. 2A is a cross-section of the discharge port means.

A discharge air hose fitting 57, shown in FIGS. 2, 2A and 6, is mounted on and integral with the cylinder head 32. More specifically, the fitting 57 is pressed into a bore 57' of cylinder head 32 and has a central bore 57A therethrough which is aligned with a bore 57B which extends to and connects with a bore 32D to be described below.

A discharge check valve means 56 is provided within a bore 32D of cylinder head 32 as shown in FIG. 2 and, in larger scale, in FIG. 2A. The lower end of the bore 32D (as viewed in FIG. 2A) has a female cone configuration 32DC terminating in a small opening 32DC' which is aligned with and is approximately the same diameter as bore 32P (see FIG. 9) of the check valve 32B. The check valve 56 comprises a cylindrically shaped valve guide 32E fixed in bore 32D; an "O" ring seal 32E' is positioned in a circumferential groove of guide 32E (as shown in FIG. 2A) to prevent air leakage. The valve guide 32E also has a central longitudinal bore 32EB opening at the bottom (as shown) and a reduced diameter bottom end 32ER, a shoulder 32ER' being defined at the top end of 32ER.

The check valve means 56 of FIG. 2A also includes a check valve 32F which has an upper shank portion 32FS which is slidably positioned in bore 32EB and a lower conically shaped nose portion 32FT which fits into and complements the female cone 32DC and also has a circumferential groove for receiving an "O" ring 32G. A coil spring 32H is positioned between the shoulder 32ER' and the upper or top surface of the nose portion 32FT to spring bias the conical nose of 32FT against the matching or complementary conical surface 32DC of bore 32D, the "O" ring 32G providing a fluid-tight seal, all as shown in FIG. 2A.

As indicated, the discharge port means 57 further include bore 57A and a bore 57B (aligned therewith) which extend through cylinder head 32 to intersect bore 32D at a point adjacent to bottom 32ER of the valve guide 32E.

During the compression stroke, the cylinder air pressure will build up and exceed the line pressure, the pressure differential will force the check valve 32F upwardly (from the closed position shown in FIG. 2A) over powering the biasing spring 32H and air then will exit the cylinder via the lower part of bore 32D, bore 57B and bore 57A of fitting 57 and thence flow to the load apparatus.

During the intake stroke, the nose 32FT is held firmly against the conical surface 32DC by the spring 32H and the discharge (or line pressure).

Figure 7:
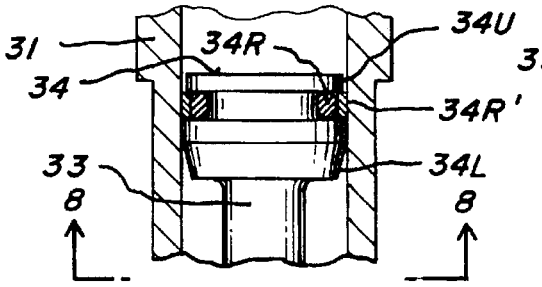
FIG. 7 is a view of part of the piston in the cylinder and FIG. 8 is a cross-section of FIG. 7 as viewed along section lines 8—8 thereof

As indicated, the piston head is reciprocated within the cylinder 31 by the described mechanism including the rocker ann 43—ball 39 connection to the end 35 of the piston rod 33. This mechanism is designed so that, when the rocker arm 43 is at its closest point to the cylinder head, the top of piston 34 is parallel to the cylinder head, i.e., the piston rod axis and the center of ball 39 are aligned with the cylinder axis 31'. At all other piston positions, the center of ball 39 is displaced from the axis 31'; this causes some "rocking" of the piston rod and piston head with respect to axis 31' and this is permitted by the top and bottom of the piston having a reduced diameter 34U and 34L as shown in FIG. 7.

At start up the top of piston 34 may actually engage the cylinder head; this is not damaging because the shock absorber 46 in the drive mechanism will absorb the motion. In fact, this feature of my invention tends to assure that there will be only a minute amount of air remaining between the piston and the cylinder head when the piston has completed the compression stroke.

Peristalic Pump

Figure 8:
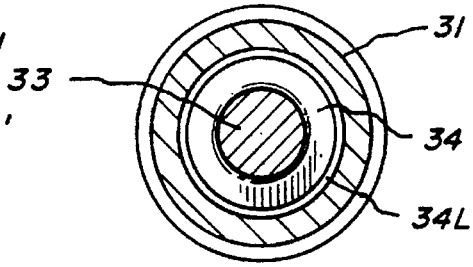
Figure 11:
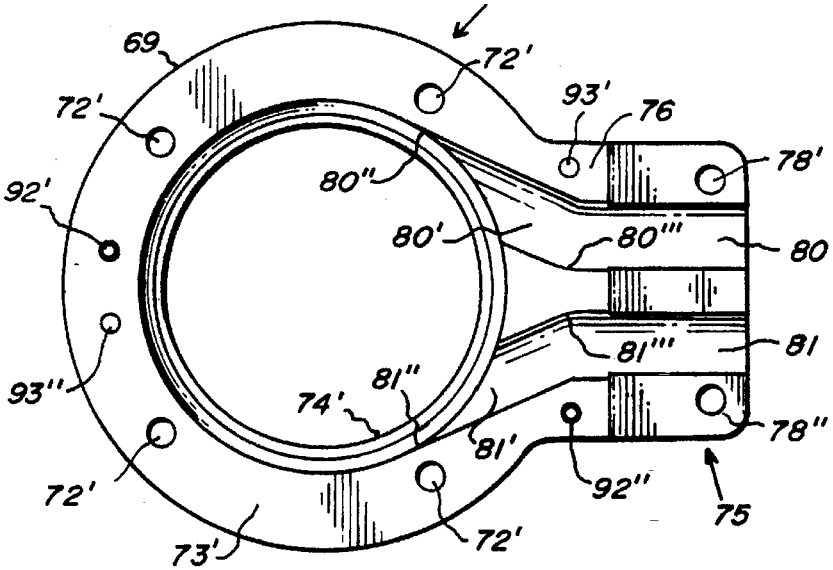
FIG. 11 is a plan view showing the mounting face or inner axial end of one of the pairs of substantially identical body members.
Figure 14:
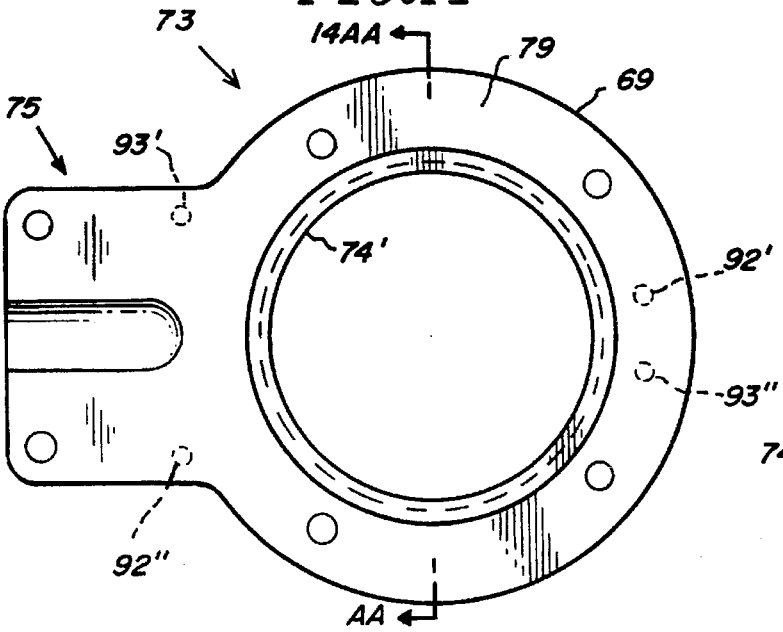
FIG. 14 is a plan view, showing the outer axial end or mounting face end of one of the body members.

Extending axially outward from portion 11B of frame 11 is a rabbet frame extension 11PP (see FIG. 4), the outer axial surface of which defines a flat mounting surface. The bore or rabbet 11PP is concentric with the shaft axis 18'. A pump housing 70 is mounted on the frame 11 and comprises in part a rabbet 74' which fits into frame rabbet 11PP. The pump housing is comprised of a pair of substantially identical body members 71 and 72 positioned in facing, abutting relationship, as shown in FIG. 4. The body members are shown in detail in FIGS. 11–14AA. Each of the body members comprises an annular portion 73 (see FIGS. 11 and 14) having a flat axial end surface 73', this being termed the "mating face" of the body. The other or opposite axial end or mounting face of each body member is identified by reference numeral 79. Each of the annular portions 73 has an inner circumferential surface 74, as well as a tube guide and clamp tang portion 75 which is integral with the annular portion and depends radially outwardly therefrom. The inner circumferential surface 74 of the annular portions 73 provide a roller carrier clearance bore. Tang portion 75 has a flat surface 76 which is an extension of said flat surface 73', as is clearly shown in FIG. 8. However, there is a clamp deflection step 77 at the outer radial extremity of tube guide and clamp tang portion 75 and is best shown in FIG. 11. A pair of holes 78' and 78" extend through the step 77 of the tube guide and clamp tang portion 75 as shown in FIG. 11. Also, a plurality of holes 72' extend through the annular portion 73 as shown in FIG. 11.

Figure 12:
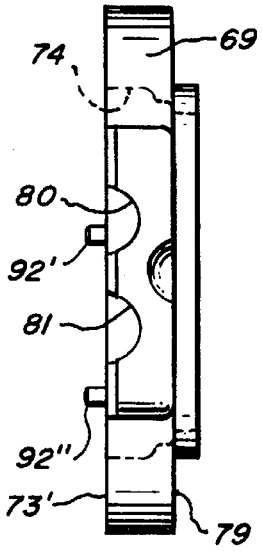
FIG. 12 is an end view of the apparatus shown in FIG. 11.
Figure 13:
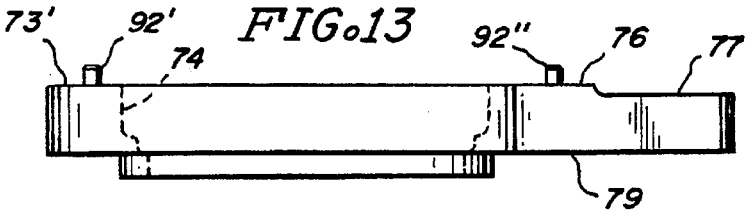
FIG. 13 is a side view of the apparatus shown in FIG. 11.

The body members 71 and 72 are further characterized by each having a pair of spaced-apart half-cylindrical grooves 80 and 81 shown in FIGS. 11 and 12, which depend from the flat surface 76 and extend from the outboard end of tang portion 75 radially inwardly through said radially extending portion 75 to midpoints where grooves 80 and 81 connect with rounded turns 80'" and 81'" which, in turn, connect groove continuations 80' and 81' which, in turn, tangentially connect with the inner circumferential surface 74 of the annular portion at 80" and 81", respectively, as shown in FIG. 11.

Figure 14A:
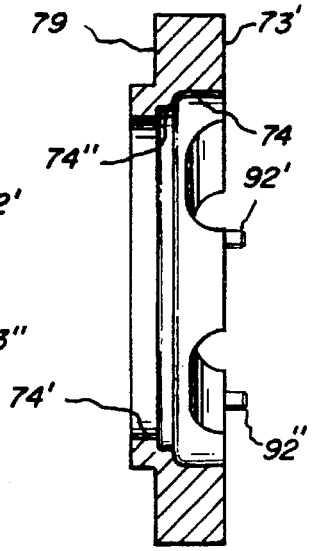
FIG. 14AA is a cross-section view of the device shown in FIG. 14 as viewed along section lines 14AA—14AA.

As shown in FIG. 14AA, each body member 71 and 72 further includes a rabbet or shoulder 74' radially extending inwardly from the inner circumferential surface 74 and at the mounting face end 79 thereof. An intermediate shoulder 74" is positioned between surface 74 and shoulder 74' (see FIG. 14AA). Shoulder or rabbet 74' also projects axially outward and has an outer diameter pre-selected to fit within the aforementioned rabbet 11PP of frame 11 as shown in FIG. 4.

Figure 4A:
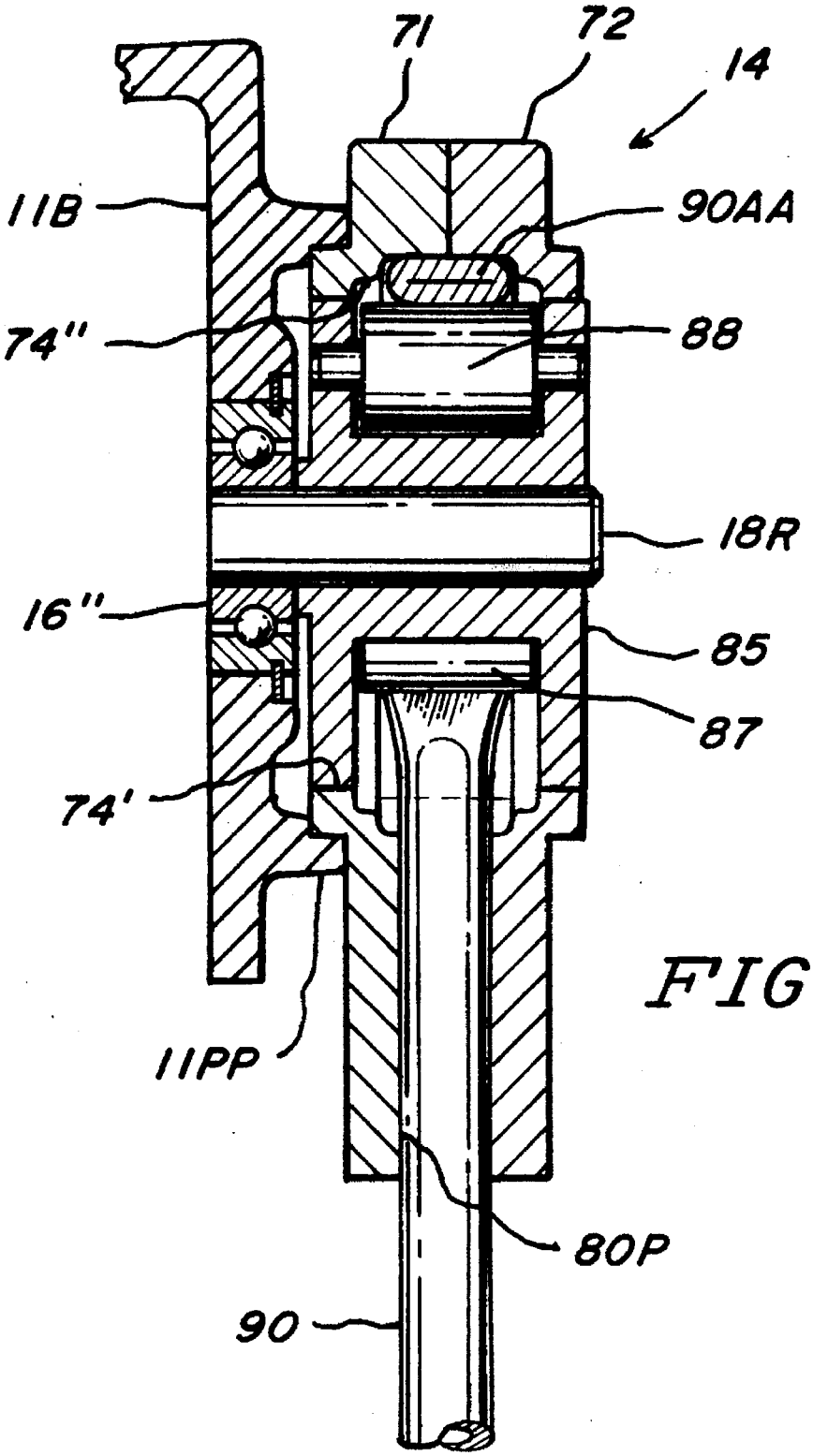
FIG. 4AA shows a cross-section of the peristalic pump with a roller in the upper most position and with the tube squeezed between the roller and the circumferential track as viewed along section lines 4AA—4AA of FIG. 5.

The pump housing is characterized, when the body members 71 and 72 are positioned with the mating face surfaces 73' in facing, abutting relationship, to define a substantial annular opening for receiving a pump rotor carrier means. The inner circumferential surfaces 74 of body members 71 and 72 jointly form a continuous circumferential track bounded at each axial end by the radially inwardly extending shoulders 74' and 74" as is clearly shown in FIG. 4. Each member 71 and 72 has a pair of dowels 92' and 92" (see FIG. 12) projecting up from the mating face surface 73 and tang surface 76 and which fit into mating dowel holes 93' and 93", respectively, (see FIG. 11) to align the members 71 and 72. Further, the half-round grooves 80–80' and 81–81', being in register with one another, form a pair of spaced-apart round tube passageways, one of which 80P is shown in FIG. 4AA.

Referring to FIG. 4, a rotor 85 is mounted on and fixed with a pressed fit to shaft 18 at end 18R thereof and is positioned in the above-mentioned bore of the pump housing. The rotor 85, in the preferred embodiment, has three separate rollers 86 and 87 shown in FIG. 4 and 88 shown in FIG. 4AA mounted thereon for rotation about axes parallel to the shaft axis 18'. For example, referring to FIG. 4, roller 86 is supported on rotor 85 by a shaft 86A and sleeve bearing means 86B for rotation about an axis defined by shaft 86A parallel to the shaft axis 18'. In FIG. 4, the top of one of the other rollers 87 is partially visible.

Flexible, compressible, hollow tube means 90 is positioned in the 80–81 round passageways and abuts the combined circumferential surfaces 74 and lies between the pump housing track and the rollers carded by rotor 85. In FIG. 4, the reference numeral 90A designates the tubing in its uncompressed state. In FIG. 4AA, the reference numeral 90AA depicts the tubing 90 as fully compressed by the roller 88.

Figure 5:
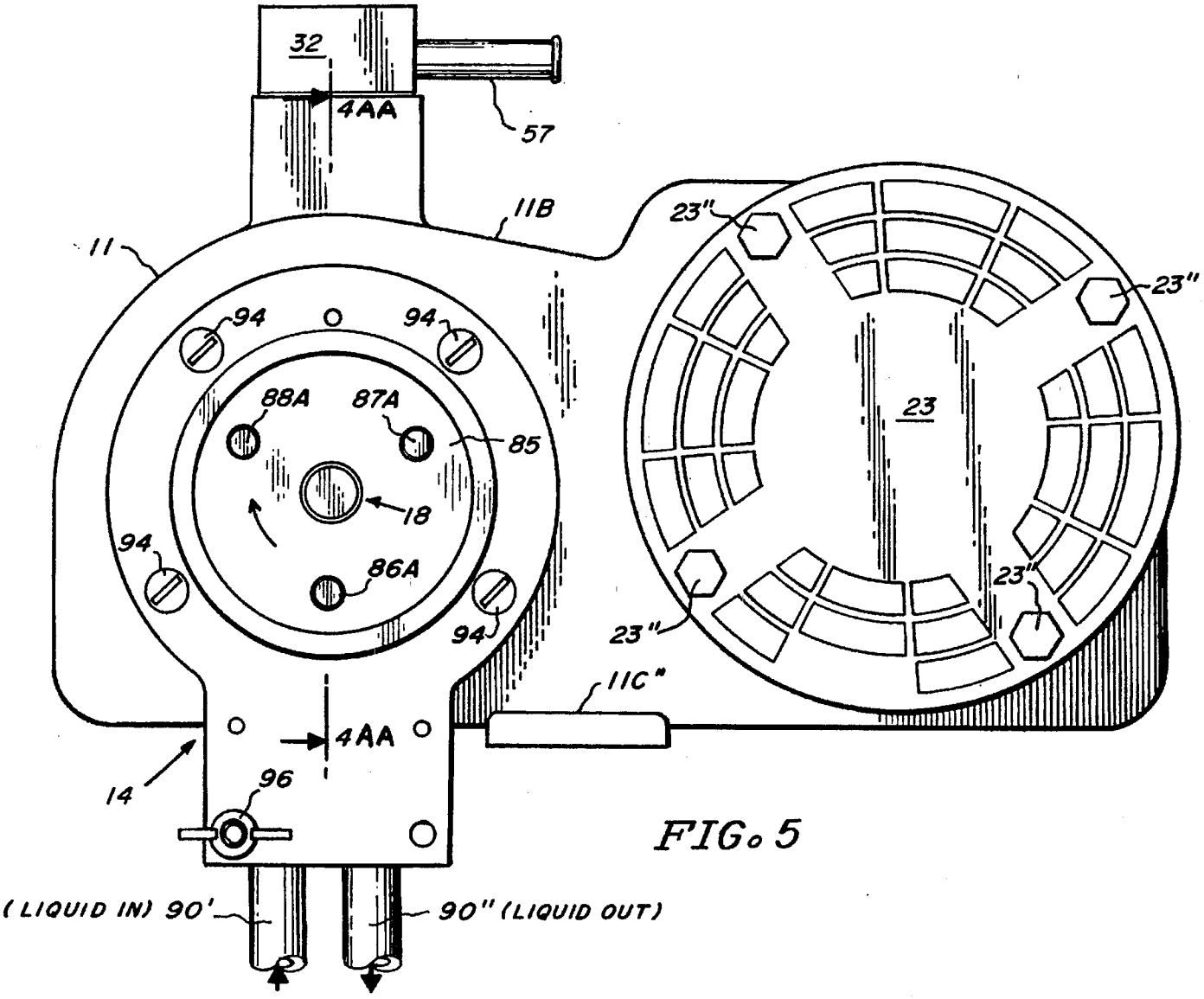
FIG. 5 is a right side view of the apparatus.

The body members 71 and 72 are adapted to be assembled as aforesaid, the faces 73' in abutting relationship, and dowels 92' and 92" co-acting with mating dowel holes 93' and 93" to align the body members one with the other. The resultant sub-assembly then is attached to the frame as shown in FIGS. 3, 4 and 5 by the use of suitable machine screws 94 passing through holes 72' and screwed into threaded holes in frame 11B. A carriage bolt 95 passing through one of the clamp screw holes 78' or 78" and a companion wing nut 96 can be used to draw or deflect together the extreme outer tips of the tube support portions 75 of the body members so as to clamp the tubing 90, the steps 77 (see FIG. 7) facilitating the deflection and thus the clamping action (see also FIG. 4).

The body members may be made of any suitable plastic or other material. One material that has been found satisfactory is sold under the tradename DELRIN.

Figure 15:
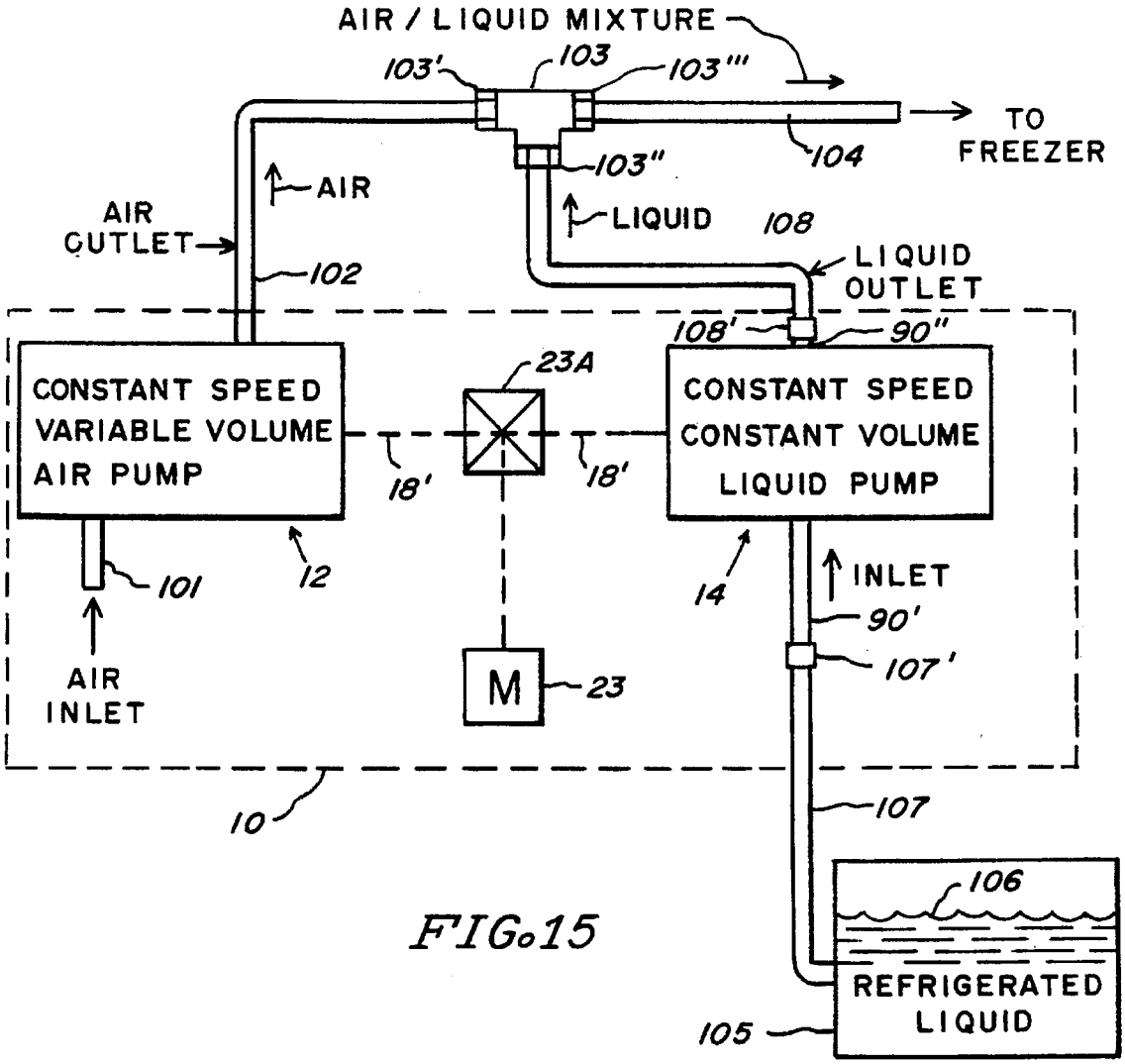
FIG. 15 is a schematic or block diagram of the unique apparatus as used in a "soft" ice cream machine.

Referring to FIG. 15, the combined air pump 12 and peristalic pump 14 are depicted schematically and, again, ate represented by the reference numeral 10. The motor 23 is schematically represented having a connection to a rotation transmission means 23A having an output means or shaft 18' driving simultaneously pumps 12 and 14. Pump 12 has an air inlet 101 and an outlet 102 which is connected at a first inlet port 103' of a mixing "T" 103. A holding tank means 105 contains a supply of refrigerated liquid 106 such as refrigerated liquid ice cream mix. A tube or pipe 107 is connected to tube 90' of pump 14 (see FIG. 5) by a coupling 107'. The outlet 90" of the pump 14 is coupled to a tube or pipe 108 through a coupling 108' and is connected to another inlet port 103" of the mixing "T" 103. The remaining port 103'" of mixing "T" 103 is an outlet port and is connected by tubing or piping 104 to be connected to a freezer or freezing means, not shown.

OPERATION

Assuming that motor 23 is energized, then the shaft 18 will be rotating at a relatively constant angular velocity all as aforesaid. Roller 28, supported by the rotating crank arm 25, will be periodically coming into contact with the lower or under surface of shock pad 46 bonded to the lower surface of rocker arm 43. As described, rocker arm 43 is at all times in engagement with the other end 35 of the piston rod through the medium of the ball 39 being positioned between recess 40 of the rocker arm and recess 35' of the piston rod. The spring means 37 biases the piston rod against the ball 39 and thus against the rocker arm 43. The amount or extent of intake travel of the piston rod is controlled by the position of the rocker arm about axis 44' which in turn is controlled by the position of the eccentric 49, all as described above. Thus rotation of shaft 18 causes periodic contact by roller 28 with the shock pad 46 to thereby periodically move the rocker arm 43 toward the cylinder and to thereby transmit force to the piston rod to thereby move the piston head periodically toward the cylinder head (compression stroke)

against the biasing force of the spring 37 to thereby compress air in the cylinder (admitted by check valve 32B on the preceding intake stroke). The eccentric 49 can be adjusted to anyone of many pre-selected settings to adjust the extent of the piston intake stroke to thereby adjust the volume of air admitted into the cylinder during the piston intake stroke and thus vary the volume of air pumped by said pump during the pump compression stroke, the pumped air being discharged through the outlet port means 57.

The eccentric 49 may be rotated, as aforesaid, by first loosening screw 58. In some cases, eccentric 49 will be set and calibrated at the factory so that the output of the pump will be a pre-selected volume. In other cases, eccentric 49 may be manually reset by an operator at a field location.

Thus, air pump 12 has the advantages of being a constant speed, variable volume pump characterized by always having a minimum gap between the cylinder head and the top of the piston head, when the piston has completed the compression stroke, for all of the variable volume modes of operation, i.e., for the pre-selected various limits to the piston intake stroke. Thus, the flow rate of the pump for the eccentric 49 setting depicted in FIG. 6 will be much less than that for the eccentric 49 position depicted in FIG. 2, but, in both cases, the top of the piston head will be immediately adjacent to the cylinder head when the piston has completed the compression stroke, i.e., is a "minimum gap" pump. The aforesaid problems of the prior art pumps are thus avoided.

FIG. 15 shows the inlet portion 90' of tubing 90, through which liquid 106 is drawn from tank 105 into pump 14. With the rotor 85 rotating as aforesaid about axis 18', the rollers 86, 87 and 88 will roll around and squeeze the tubing 90, as described above, so as to pump liquid out through discharge portion 90" of the pump toward mixing "T" 103.

In order to load tubing into the pump, the motor 23 must be running and the wing nut 96 loosened so as to permit the tubing to be inserted into the pump body. The tubing is fed into one of the passageways. The rotation of the rollers will facilitate feeding the tubing in, around and adjacent to the circumferential track and then is out through passageway. Once the tubing is positioned as desired, the wing nut 96 is then tightened down so as to pinch the tubing and hold it in place with respect to the pump housing. In the preferred embodiment, the roller bearing means are preferably oil-less sleeve bearings (rather than ball bearings); sleeve bearings have a higher, pre-selected level of friction which will assist in gripping the tubing during the loading of the tubing. Thus the tubing may be very quickly adjusted or replaced without stopping the motor. This is a major advantage of my invention over the prior art peristalic pumps which require shut-down and partial disassembly so as to adjust or replace the tubing.

The grooves 80–80' and 81–81' of FIG. 11 are sized slightly larger than the tubing means 90.

The tubing 90 is thus snugly supported by the grooves 80–80' and 81–81' throughout the tube guide and clamp tang portion 75 up to tangential entry (and exit) of the track formed by the surfaces 74. This facilitates the tubing being centered (as shown in FIG. 4) and reduces tubing wear.

Referring again to FIG. 15, motor 23, when energized, will drive both pumps 12 and 14 through the shaft 18'. Assuming that the motor 23 is a constant speed motor, then both pumps will be constant speed. Pump 14, because of the inherent operating characteristics of peristalic pumps, will tend to be a constant volume output pump given the constant speed input. Thus, the refrigerated liquid 106 will be pumped at a constant rate into the mixing "T" 103, all as aforesaid. Simultaneously, pump 12 is pumping air into the mixing "T" 103, as aforesaid, but the volume of the air pumped by pump 12 can be adjusted to any one of a plurality of pre-selected levels, all as explained above. Thus, the resultant air/liquid mixture emerging from port 103'" of the mixing "T" 103 can be set to any one of a number of pre-selected ratios.

Because of the characteristics of the unique air pump 12, even at start-up, the ratio of air to liquid at 104 will be as preset. Further, if the pump 12 is set at the factory, then there will be no adverse variation in the pump performance even if the apparatus is used at an elevation different from the factory elevation.

I claim:

1. A combined variable volume air pump and peristalic pump apparatus comprising:

a) a frame;

b) a shaft rotatably supported by said frame for rotation about a shaft axis and means for rotating said shaft;

c) a variable volume air pump mounted on said frame and operatively connected to said shaft, said air pump comprising:

1) crank arm means fixed to said shaft so as to rotate therewith, 2) a pump cylinder supported by said frame, having a cylinder head and a cylinder body depending therefrom along a cylinder axis, 3) a piston rod having a piston head at one end thereof positioned in said cylinder for relative reciprocation therewith along said cylinder axis, said piston head being closely adjacent to said cylinder head upon completion of a compression stroke, and said piston rod having at its other end means for receiving force tending to move said piston head toward said cylinder head, 4) spring means connected between said frame and said piston rod for biasing said piston head away from said cylinder head, 5) piston rod engagement means:

(i) rotatably mounted on said frame for movement relative to said cylinder axis, (ii) positioned to engage said other end of said piston rod whereby said piston rod engagement means is biased (by said force of said spring means) to move away from said cylinder, and (iii) being further positioned so as to be contacted by said crank arm means, 6) adjusting means for selectively varying the extent of movement of said piston rod engagement means away from said cylinder head to thereby vary the intake stroke travel of said piston rod, 7) intake check valve means adapted to:

(i) admit air into said pump cylinder during the intake stroke, and (ii) prevent airflow therethrough during the compression stroke, and 8) outlet port means including discharge check valve means located in said cylinder head, whereby rotation of said shaft causes contact by said crank arm means with piston rod engagement means to thereby periodically move said piston rod engagement means toward said cylinder head and the thereby transmit force from said piston rod engagement means to said piston rod to thereby periodically move said piston head toward said cylinder head against the biasing force of said spring to thereby compress air in said cylinder admitted by said intake check valve means, and whereby, further, said adjusting means may be adjusted to a pre-selected condition to adjust the extent of the piston intake stroke travel to thereby adjust the volume of air admitted into said cylinder during the piston intake stroke and thus vary the volume of air pumped through said discharge check valve means during the compression stroke, and d) a peristalic pump mounted on said frame and operatively connected to said shaft, said peristalic pump comprising:

1) a pump housing mounted on said frame, said housing having an inner circumferential track and a central opening, 2) a rotor mounted on said shaft and positioned in said annular opening of said pump housing, said rotor having at least two rollers mounted thereon for rotation about axes parallel to said shaft axis; and 3) flexible, compressible, hollow tube means positioned in said passageways and between said pump housing and said rollers;

whereby fluids may be pumped through said tube when said rotor is rotated, the dimensions of said tube, said circumferential track, said rotor and said rollers being pre-selected so that said tube is squeezed between said rollers and said track.

2. Apparatus of claim 1 further characterized by said piston rod engagement means comprising a rocker arm pivotally mounted on said frame.

3. Apparatus of claim 2 further characterized by shock absorption means being provided on said rocker arm at the location of said contact by said crank arm means.

4. Apparatus of claim 3 further characterized by said adjusting means comprising eccentric means rotatably mounted on said frame positioned to be in engagement with said rocker arm so as to limit the movement of said rocker arm away from said cylinder, and means for selectively locking said eccentric means to said frame at any of a plurality of pre-selected angular positions about its rotational axis to thereby have respective pre-selected portions of said eccentric means engage said rocker arm to thereby limit the intake stroke of said piston rod to a plurality of pre-selected positions.

5. Apparatus of claim 2 further characterized by said rocker arm being mounted on said frame for rotation about an axis parallel to said shaft axis.

6. Apparatus of claim 1 further characterized by said cylinder axis being substantially perpendicular to shaft axis.

7. Apparatus of claim 1 further characterized by said discharge check valve means permitting air flow from said cylinder during the compression stroke and to prevent air flow into said cylinder during the intake stroke.

8. Apparatus of claim 4 further characterized by means for providing a visual indication of the angular position of said eccentric means with respect to said frame.

9. Apparatus of claim 8 further characterized by said visual indication means comprising an indicia scale bonded to said eccentric means and a pointer mounted on said frame adjacent to said scale.

10. Apparatus of claim 9 further characterized by said rocker arm and said eccentric means being rotatably mounted on said frame for rotation about axes parallel to said shaft axis.

11. Apparatus of claim 1 further characterized by said crank arm means comprising a roller rotatably mounted on an end of a crank arm for rotation about an axis parallel to said shaft axis, whereby said roller periodically contacts said piston rod engagement means.

12. Apparatus of claim 1 further characterized by said peristalic pump housing having a pair of substantially identical body members positioned in facing, abutting relationship, each of said body members comprising:

a) an outer portion having a flat axial end surface and an inner circumferential surface, b) a tube guide and clamp tang portion integral with said outer portion and extending radially outwardly therefrom, c) a pair of spaced-apart half-round grooves depending from a surface of said tube guide and clamp tang portion and extending radially therethrough to said inner surface of said outer portion, and d) a shoulder radially extending inwardly from one axial end of said outer portion, said pump housing being characterized, when said body members are positioned with said flat axial end surfaces in facing, abutting relationship, as aforesaid, by defining an annular opening for receiving a pump rotor means, and said inner circumferential surfaces forming a circumferential surface bounded at each axial end by one of said radially extending shoulders, and said grooves forming a pair of space-apart round passageways;

whereby fluids may be pumped through said tube when said rotor is rotated, the dimensions of said tube, said circumferential track, said rotor and said rollers being pre-selected so that said tube is squeezed between said rollers and said track.

13. Apparatus of claim 12 further characterized by including a means for locking said tube means with respect to said pump housing.

14. Apparatus of claim 13 wherein said locking means comprises a means for applying force to said tube guide and clamp tang portions, tending to deflect them toward one another.

15. Apparatus of claim 14 further characterized by said force applying means comprising screw and nut means extending through said tube guide and clamp tang portions at said recessed outer radial extremities thereof.

16. Apparatus of claim 12 further characterized by each of said shoulders being spaced from said flat axial end surface.

* * * * *